United States Patent [19]

Beckers

[11] 4,039,175

[45] Aug. 2, 1977

[54] PROCESS AND APPARATUS FOR REMOVING DUST PARTICLES DISPOSED BETWEEN THE LINING OF A CASTING LADLE AND A TEMPLATE

[75] Inventor: Karl Dieter Beckers, Neunkirchen-Seelscheid, Germany

[73] Assignee: Martin & Pagenstecher GmbH, Cologne-Mulheim, Germany

[21] Appl. No.: 746,575

[22] Filed: Dec. 1, 1976

[30] Foreign Application Priority Data

Jan. 20, 1976 Germany ..... 2601947

[51] Int. Cl.[2] ..... F27D 1/16

[52] U.S. Cl. ..... 266/281; 264/30

[58] Field of Search ..... 164/20, 198; 264/30; 266/281, 287, 44

[56] References Cited

U.S. PATENT DOCUMENTS 3,872,912 3/1975 Axmann ..... 164/20

*Primary Examiner*—Gerald A. Dost

*Attorney, Agent, or Firm*—Burgess, Dinklage & Sprung

[57] ABSTRACT

A process for removing dust produced in the lining of casting ladles wherein a slinging mass is slung between the inner walls of the ladle and an opposing template whereby a free space is defined between the ladle wall and the template which free space contains dust which process involves sucking the dust in the free space from a point near the upper edge of the template into a region behind the template; an apparatus for performing such a process comprising a template, a suction conduit inside said template having an inlet and an outlet, the inlet being in fluid communication with particles disposed near the upper edge of said template, the suction conduit including filtering means for filtering out entrained particles from air sucked therethrough, the filtering means including means for collecting filtered particles, the outlet end of the suction conduit includes means for sucking air therethrough.

19 Claims, 5 Drawing Figures

Fig. 2 (A-B)

PROCESS AND APPARATUS FOR REMOVING DUST PARTICLES DISPOSED BETWEEN THE LINING OF A CASTING LADLE AND A TEMPLATE

BACKGROUND OF THE INVENTION

1. Field of the Invention

This invention relates to a process and apparatus for removing dust and other particles which are present as a result of slinging a slinging mass into the free space between the wall of the casting ladle and an inserted template to build up the lining. More especially, this invention relates to an apparatus for removing residual dust, dirt and debris, especailly fine said particles and the like, which are whirled up during a slinging process wherein a slinging mass is applied to the walls of a casting by slinging the mass vertically from above into a free space between the inner walls of the casting ladle and a defining template spaced therefrom.

2. Discussion of the Prior Art

The preparation of refractory linings for vessels to be employed in metals refinery is known. A device for the production of such a refractory ling is disclosed in the British Pat. No. 1,326,097, or the U.S. Pat. No. 3,872,912 which technique is specifically referred to for better understanding. According to some of the known processes a template is disposed opposite the walls of the vessel to be lined so as to define the region is which the liner is to be formed. The slinging mass is slung using known slinging apparatuses such as those disclosed in German Pat. Nos. 1,235,522 and 2,004,429, corresponding to U.S. Pat. No. 3,872,912. Other slinging machines are disclosed in German Pat. Nos. 1,247,561 and 1,289,963. The slinging machine disclosed in British Pat. No. 1,326,097 can also be employed as well as the device disclosed in German Offenlegungsschrift No. 1,483,584. According to the state of the art the lining of casting ladles is carried out wherein the refractory mass is slung in quick succession and at high speed by the use of the slinger head of the slinging machine into the free space between the wall of the ladle and a template inserted therein.

The mass employed includes a sand composition. Slinging of the slinging mass including the slinger sand causes a dust nuisance for operating personnel owing to the high proportion of fine grains in the sand and the air introduced during the slinging operation which is usually at a high velocity. This nuisance is particularly acute in the region surrounding the free space between the refractory wall and the template. Because of these nuisances it has heretofore been proposed to add moisture or oil to the dry masses. Other methods for reducing the dust nuisance have included sucking off the collected dust upwards from the free space to decrease the dust nuisance. However, to effectively decrease dust nuisance it has been necessary to provide a suction hood over the point where the dust forms. This known suction procedure is not only expensive and cumbersome but has proven to be unsatisfactory even with high suction performance as the formation of dust still leads to hinderances and nuisances to operating personnel.

It is therefore an object of this invention to provide a process and apparatus which guarantee good and effective dust removal from the region surrounding the free space between the walls of the refractory vessel and the template. It has become an object of this invention, moreover, to provide an apparatus which can be effectively employed which does not require the use of a hood disposed over the free space. Moreover, it has become desirable to provide a process and apparatus for effective dust removal whereby the dust removal can be effective with substantial unimpairment to the slinging operation itself.

SUMMARY OF THE INVENTION

The objects and longfelt disideratum are realized in accordance with the present invention which contemplates a process for removing dust during the lining of casting ladles wherein a slinging mass is slung between the inner walls of a ladle and an opposing template whereby a free space is defined between the ladle wall and the template which process comprises sucking said dust in said free space from a point proximate the upper edge of the template into a region behind said template. In accordance with the present invention the dust and other small particles and debris obtained in the free space between the vessel walls and the template are sucked from a region near the upper edge of the template to a point behind the template by applying a negative pressure to such sand particles and/or dust and removing the particles downwardly in entrained sucked air through a filter chamber comprising a filter means. The air is withdrawn, preferably through a radially disposed portion of a suction tube which is in fluid communication with a centrally disposed centering tube which includes a means for sucking the air through the suction conduit.

In operation a generally slightly conical template is disposed opposed with space parallel to the walls of a reactor or other vessel employed for metal refinering, e.g., ladle. This defines a free space in which a slinging mass is to be slung. The slinging mass is slung by the slinger machines into the free space whereby a portion of the same is disposed against the walls of the cylindrical vessel. Dust and other small particles are removed by sucking the same proximate the upper edge of the facing template. The dust is withdrawn downwardly in filter tubes which allow the sucked air to pass (for instance made of fabric). The filters allow egress of the air while retaining the dust particles. The filter tubes are generally vertically disposed in a filter chamber behind the template and serve to feed a collection means. Disposed in facing relationship to a lateral side of the filter tubes is a portion of the suction tube which is generally horizontally disposed and proceeds radially from a centrally disposed hollow centering tube. In operation a single centrally disposed hollow centering tube is employed to which are connected a plurality of suction conduits which radiate radially therefrom. Each of these suction conduits passes through an elastic seal and is in facing relationship to at least one filter tube of the type described supra. The filter tube lies in a generally vertically disposed filter chamber an upper portion of which is in fluid communication with a region above the upper edge of the template. The common centrally disposed hollow centering tube is disposed centrally of the walls of the template and includes a means for sucking air through the various conduits. When air is sucked all of the dust in the free space encounters a negative pressure whereby it is withdrawn from over the upper edge of the template, and descends into the filter chamber within the filter tubes. Air is withdrawn through the small perforations of the filter tubes into the radial portion of the suction conduits where it passes into the centrally disposed common centering tube including the means for sucking air therethrough. The filtered dust is maintained within the filtering tubes and descends by gravity into a collection means.

Thus in operation the dust forming at about the upper edge of the template is preferably directed upwards into an inner area of the template wherein it is thereafter deflected downwardly behind the template into a further inner area. The upward suction and the subsequent deflection offer the advantage that direct suction of the slinging refractory mass is prevented while at the same time the dust which is whirled up from below can be sucked off without hindrance to the slinging operation.

According to a preferred embodiment of the process the suction capacity, considering the suction cross-section leading from the free space between the ladle wall and the template to the inner area of the template, is dimensioned in such a way that the pressure difference between the free space and the inner area of the ladle that is exposed to the effect of suction amounts to at least 200 kg/m$^2$. With such a pressure differential the speed of the dust entering through the cross section amounts to no more than 15 meters per second and consequently satisfactory removal of dust from the free space is guaranteed.

A device which is particularly suitable for carrying out the process is one comprising a template having a circumferential suction slot as a suction cross-section in the area of its upper edge. A filter chamber is disposed behind the walls of the template and inwardly of the cylindrical template. The filter chamber extends generally in the same direction as the template in the inner area of the template and is in fluid communication with the suction slot functioning as the inlet to the suction conduit. The filter chambers are in turn connected with a centrally disposed hollow centering tube through a radial portion thereof. The centering tube includes a means functioning as a suction aggregate.

In the apparatus of the invention it is important that the template and centering tube are carriers of the elements employed for dust removal. Thus a suction hood which is necessary in conventional dust removing units and which necessarily had to be disposed over the point where the dust collects, can be completely discarded.

The means for filtering the entrained air to leave behind the dust for collection can comprise any number of the separation systems. Preferably, the vertically disposed filter chamber comprises a plurality of filter hoses which extend collectively annularly along the inner wall of the template and are fed into dust collection funnels at their lower ends. Such an apparatus is particularly advantageous.

According to a preferred construction four dust collection funnels are provided so that each dust collection funnel covers a quadrant of the template (90°). In such an instance eight to 12 filter hoses, for example, can be provided in each quadrant.

The circumferential suction slot at the upper edge of the template which serves as an inlet to the respective suction conduits is positioned for expedience at a short distance below the upper edge of the template itself and is substantially vertically coplanar thereof. Generally speaking, the slot is between 10 and 40 cm, preferably between 20 and 30 cm below the upper edge of the template. Preferably the circumferential slot is provided with stabilizing bars which are equally distributed along the periphery of the template. Particularly advantageous construction is one in which the lower edge of the suction slot is drawn somewhat within the inner area of the suction conduit so as to be disposed within the cylindrical area of the cylindrical template. This can be achieved simply by bending the lower edge of the conduit towards the inner area of the template. The bending is coordinated for expedience with the desired acceptance cross-section. Bending at an angle with which the space from the upper edge to the bend lower edge amounts to 30–80 mm., preferably 50–70 mm., has proven particularly advantageous.

According to the invention the upper edge of the template can be undercut by means of the lower edge of the suction slot which is disposed inwardly of the cylindrical template. Direct penetration of the refractory mass slung by the slinging machines is prevented by this undercut while at the same time the dust which is whirled up is readily sucked off upwards in the direction in which it is moving into the inner area of the template. Here it is deflected within the suction conduit downwardly toward the filter means and the radial portion of the suction conduit leading to the centering tube.

The latter construction enables the lining of the ladle or other vessel to be slung with a slinger mass on the underside of the suction slot or even beyond the same whereby the suction slot locks in the final phase of the slinging operation to form an annular mass edge on the inner side of the lining being formed. This annular mass edge, however, can readily be removed by the use of a door on the template which when opened allows the template to be constricted thereby assuming a smaller diameter. Suction on the dust in the free zone withdraws the dust readily through the suction conduit and the dust is collected in the collecting means provided. In this operation the annular mass edge is removed by shearing and the constricting action of the template.

The device of the present invention preferably comprises a plurality of the suction tubes each of which is securely connected to a common vertical centering tube. A portion of the suction tubes or conduits extends radially from the respective filter chambers thereby joining the filter chambers with the common vertical centering tubes. The portion of the suction tube disposed radially from the vertical centering tube to the filter chamber is preferably displaceable in the radial direction. In order to achieve this radial displaceability in the filter chamber the free end of the portion of the suction chamber is preferably guided through an elastic seal into the filter chamber. This construction enables the template to be contracted on opening the template door. The suction can be provided by a suction aggregate preferably disposed on the lower end of the centering tube. This means can comprise a ventilator, for example, whereby the suction aggregate feeds into an air duct for drawing off the dust-free spent air.

One embodiment of the invention includes the use of divided templates. The divided templates are both in the form of a cylinder and one of the template portions is disposed over the other. Each of the divided templates includes at least one suction slot with its respective filter chamber and centering tube. The centering tubes of the respective individual templates can be connected by a guide tube so as to be coaxial with one another and in fluid communication. Thereby a single suction device can be employed for the individual templates. Preferably, the suction device is arranged on the lower end of the centering tube. A suction slot is provided whose lower edge is drawn inwardly, as described above, in the case of the dividing template. The entire suction capacity of the suction device is arranged on the lower centering tube, after locking of the suction slot of the lower template, for the suction slot of the upper individual template.

By the device of the invention, are more fully described below, good dust removal is provided with the limited capacity of the suction device by sucking off the collecting dust into the inner area of the template and collecting off within the area of the template the separated dust. Using the device of the invention one can sling refractory masses which have a relatively high proportion of dust. This can be done without creating a dust nuisance and hence the problems in dust nuisances are no longer crucial and no longer limit the composition of the refractory mass to be employed. Furthermore the removal of the dust is carried out without the use of excessive infiltrative air. The type of dust removal provides a constructive solution to the problems of dust presence by a compact arrangement involving minimum interference with the slinging operation itself. The template itself and/or the centering tubes of the template furthermore act as carriers for the construction elements employed for the dust removal. Moreover, the solution to the problem is effected using a device which consumes little space and provides a good suction effect.

BRIEF DESCRIPTION OF DRAWINGS

The invention can be more readily understood and appreciated when reference is made to the accompanying drawings in which.

DESCRIPTION OF SPECIFIC EMBODIMENTS

Figure 1:
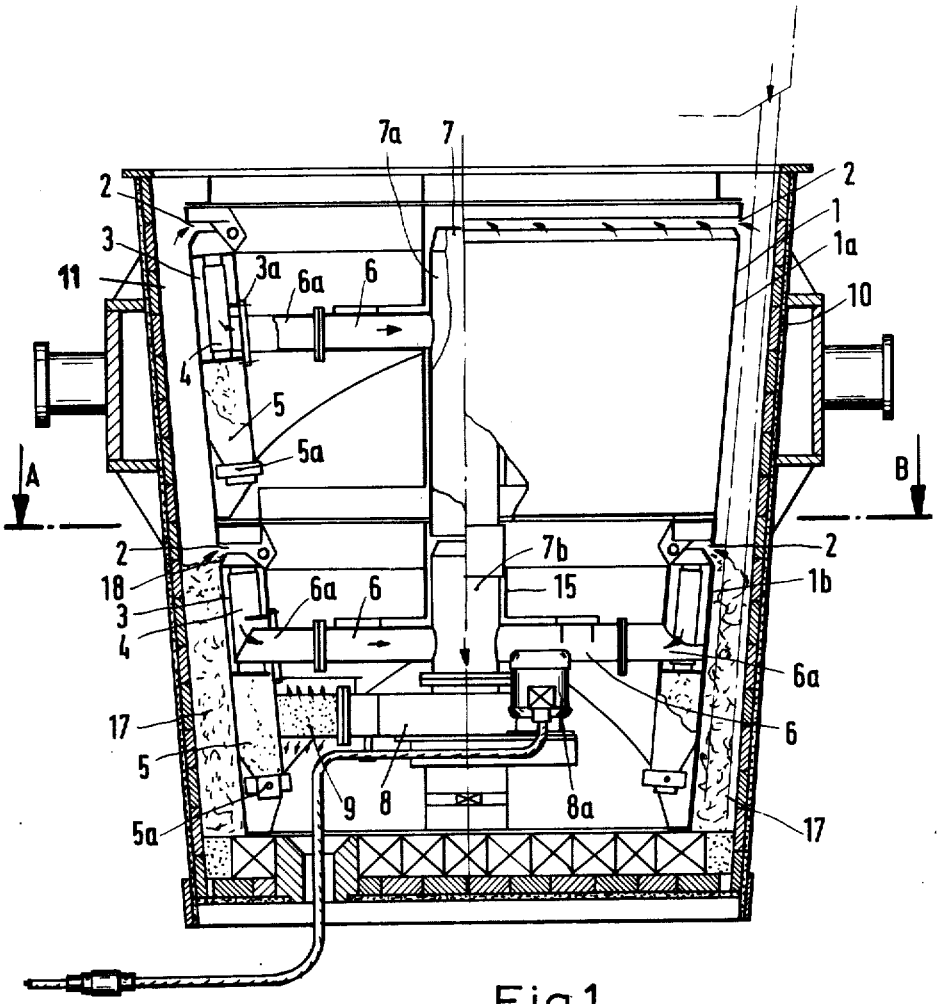
FIG. 1 is a longitudinal sectional view through a casting ladle to be lined provided with a builtin template assembly including means for dust removal.
Figure 2:
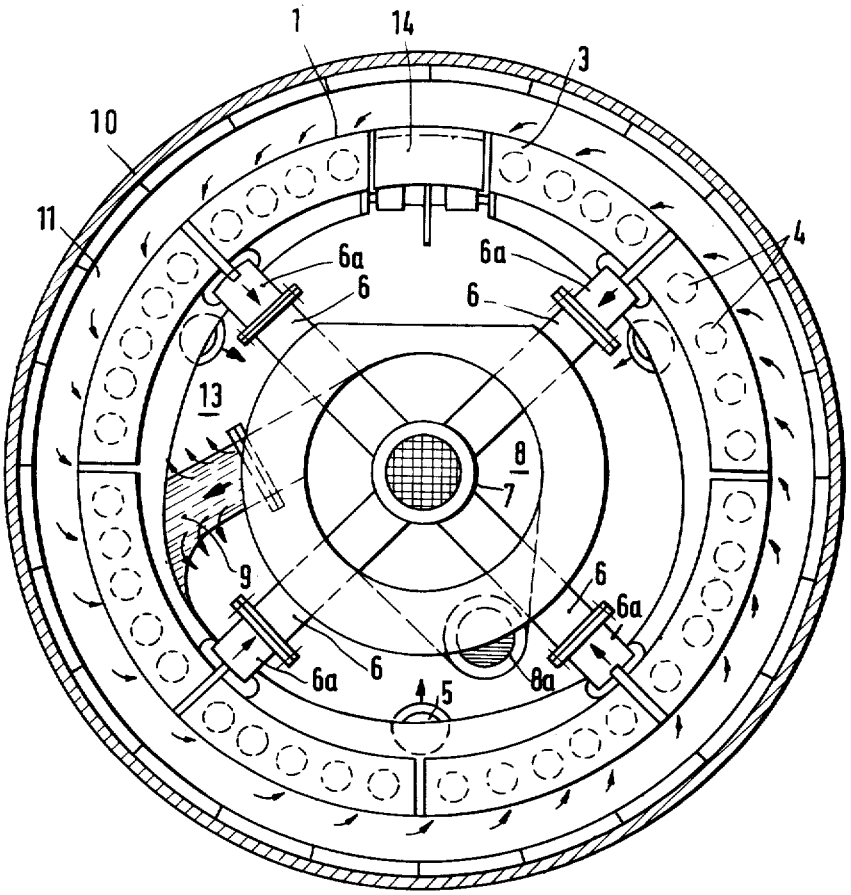
FIG. 2 is a cross-section taken along the line II—II of FIG. 1.
Figure 3:
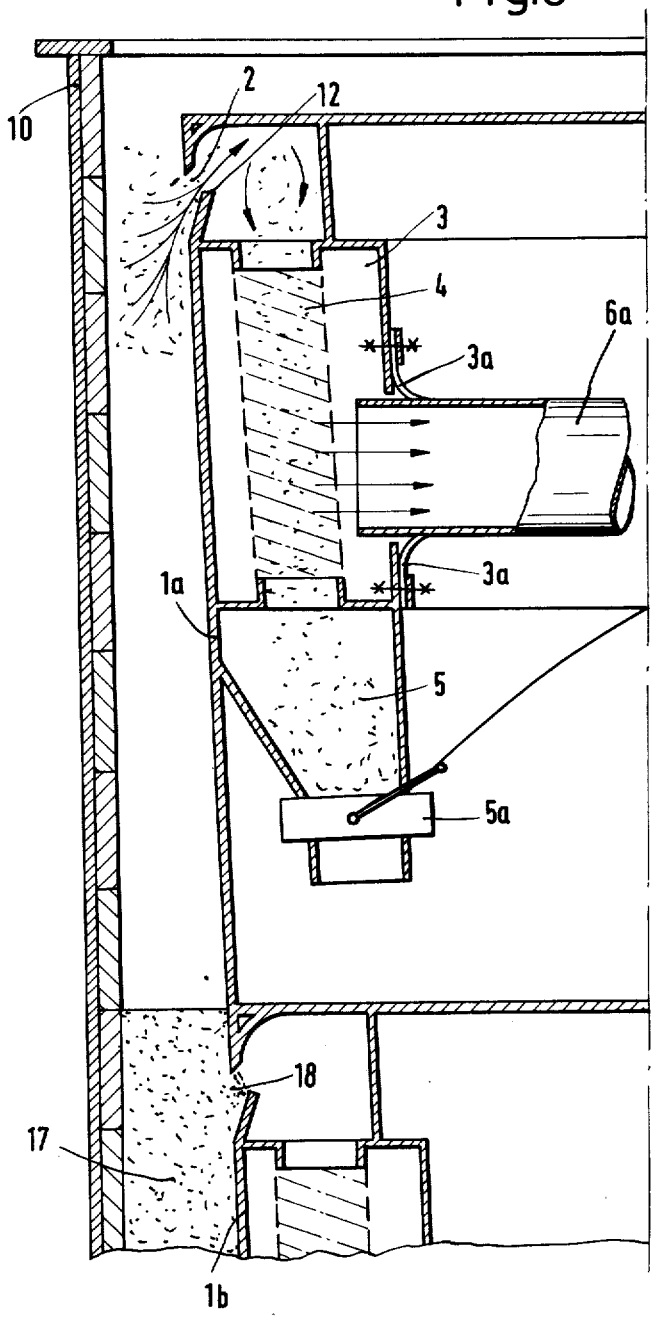
FIG. 3 is an enlarged detailed view of FIG. 1.

Referring to FIGS. 1 to 3 there is shown a casting ladle 10 having a built-in template 1. The ladle 10 has the usual cylindrical, but slightly conical form and the template corresponds to this thereby forming a free space 11 between ladle 10 and template. For lining the ladle 10 the free space 11 is filled by slinging a refractory slinging mass by a slinger head of a slinger machine. The operation of the slinger machine including repeated circuits around the space 11 is known to the specialist by U.S. Pat. No. 3,872,942.

According to FIG. 1 the template 1 is formed of individual divided templates comprising an upper template 1*a* and a lower template 1*b*. A centering tube 7 is formed for the entire assembly comprising an upper centering tube 7*a* and a lower centering tube 7*b*, belonging to template 1. A suction device having a drive 8*a* and a ventilator element 8 is provided on the lowering centering tube 7*b* which leads from the lower centering tube 7*b* to the air duct 9. The suction device is positioned at the lower end of the centering tube 7, i.e., the lower end of the lower centering tube 7*b* as shown in the drawings and is securely connected to the centering tube 7.

Removal of dust from the free space 11 between the ladle 10 and the template 1 is achieved by the device which sucks air through the suction slot 2 disposed in short distance below the upper edge of the template 1. The air containing entrained free sand dust is therefore sucked through the slot 2 of the template 1 to an area within the cylindrical template and behind the same. The entrained dust is separated off within a filter chamber 3. The filter chamber 3 constitutes a portion of the overall suction conduit. A portion of that suction conduit is tube 6 which is radially disposed in facing relationship to a lateral side of a filter and extends towards centering tube 7 and from there to the air duct 9 via the ventilator element 8.

Figure 4:
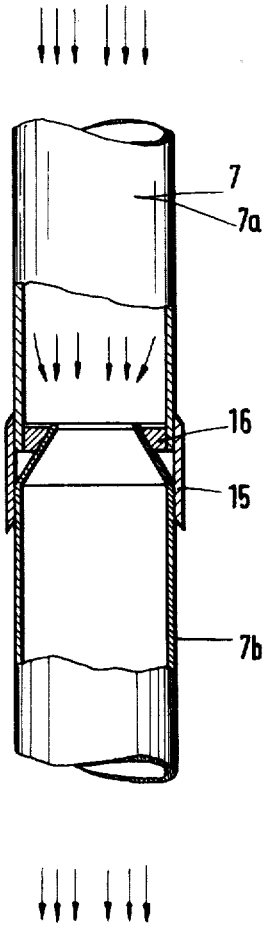
FIG. 4 is an enlarged detail of an area of the centering tubes.

In the case of a devided template 1 comprising an upper template 1*a* and a lower template 1*b* each of the templates has its own slot 2, filter chamber 3, suction tube 6 and centering tube 7, whereby the upper part 7*a* and the lower part 7*b* of the centering tube 7 can be connected as explained later (FIG. 4).

The air duct 9 is guided for expedience against the inner side of the filter chamber 3. In this way stabilization is achieved. According to one embodiment the air duct 9 is guided directly along the filter chamber, whereby a relatively high proportion of spent air can be received, deflected and distributed.

Referring to FIG. 3 a suction slot 2 is provided having a cross-section a short distance below the upper edge of the template 1. The suction slot 2 is formed by the drawing inwardly of the lower edge 12 into the inner area of the template, i.e., within the cylinder of the template itself. As shown in FIG. 3, the lower edge 12 is drawn so far into the inner area of the template that the distance from the upper side of the undercut 12 amounts to about 60 mm.

The slot 2 being on the entire portion of the template can be provided with stabilizing bars (not shown) so that the slots 2 are equally distributed about the periphery of the template. The filter chamber 3 extends downwardly parallel to the template 1 and comprises a plurality of filter hoses 4, wherein several filter hoses at a time feed into a conical dust collection funnel 5 which can be emptied by means of a manual slide damper 5*a*. The number of dust collection funnels 5 is governed by the diameter of the template 1 and amounts to four in the shown example.

FIG. 2 shows the suction tubes 6, which are securely connected with the centering tube 7 and feed into the filter chamber 3. Four suction tubes 6 in all, each desplaced at 90°, are provided in the shown example. The suction tube 6 terminates in the filter chamber with its free end 6*a* through the elastic seal 3*a* so that a relative radial movement is possible between the filter chamber 3 and the suction tube 6. This is desirable when the template 1 is removed in order to facilitate a contraction of said template 1 on opening the door 14 of the template.

FIG. 4 shows that, in the case of a template 1 of several parts having a respective centering tube 7 of several parts, the upper centering tube 7*a* can be connected with the lower centering tube 7*b* by a guide tube 15 whereby a rubber ring 16 provided in the upper centering tube 7*a* to effect the sealing.

Figure 5:
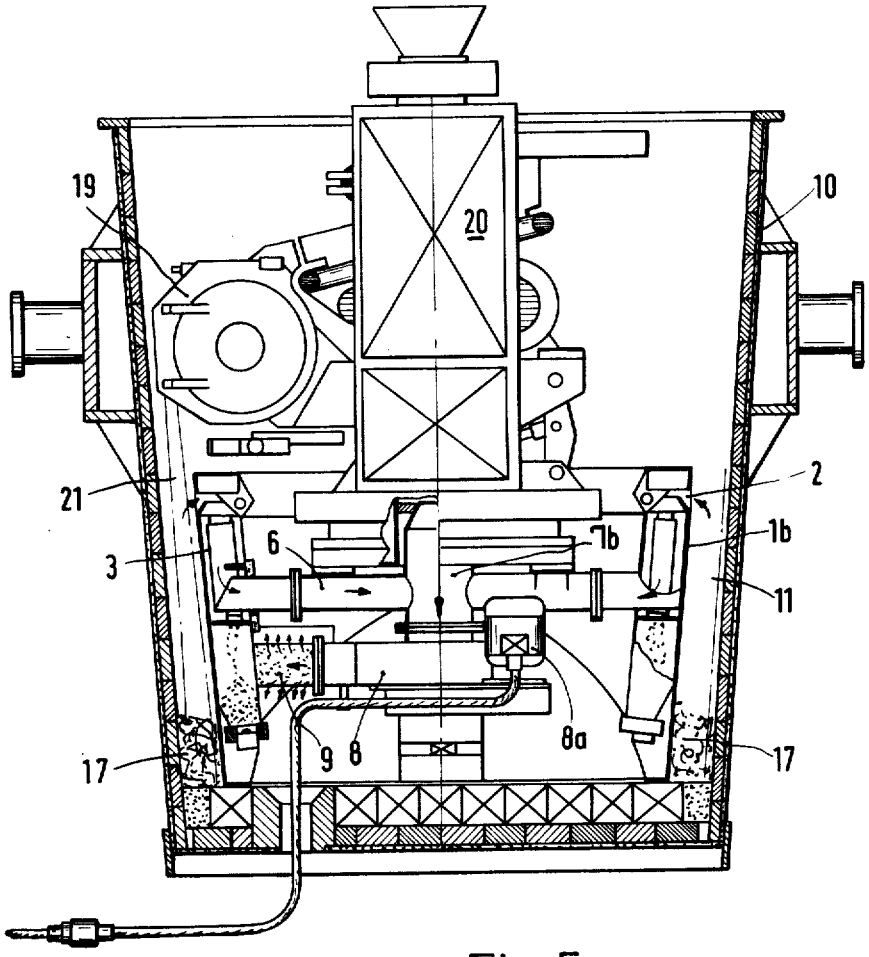
FIG. 5 shows a longitudinal section view through the casting ladle with a lower part of the template inserted and mounted by the slinger machine.

FIG. 5 shows the location of the slinging device 20 when slinging the lower section of the ladle lining in the case of a two-section slinger operation having individual devided templates. The casting ladle 10 having built in the lower template 1*b* which has its own slot 2, filter chamber 3, suction tube 6 and the lower centering tube 7*b* to which the drive 8*a*, the ventilator element 8 and the air duct 9 are connected. The slinger device 20 mounts the lower centering tube 7*b* thereby locking the open upper end of the lower centering tube 7*b*. The slinger head 19 of the slinger device 20 is directed vertically from above into the free space 11 between the ladle 10 and the lower centering tube 1*b*. The mass stream 21 slung by the slinger head 19 builds up the lining 17.

The operation of a two-section slinger having two individual divided templates is explained as follows:

A suction device 8, 8*a* operates through the use of a centering tube 7. Initially, the lower centering tube 7*b* and lower template 1*b* with the respective suction slot 2, filter chamber 3 and suction tube 6, only is employed. The lower centering tube 7*b* is, however, locked by the slinger device 20 placed thereon during the slinging of the lower portion of the ladle 10. Shortly before the locking of the suction slot 2 of the lower template 1*b* the slinger device 20 is raised by a crane. Then the upper assembly comprising the upper template 1*a* with its own slot 2 below the upper end and with the respective filter chamber 3, suction tube 6 connected to the respective upper centering tube 7*a* are put in place. The upper centering tube 7*a* is disposed upon the lower centering tube 7*b*, which is now open to the top as the slinging device 20 has been removed. Upper centering tube 7*a* and lower centering tube 1*b* are connected by using guide tube 15 shown in FIG. 4. Then the slinging device 20 is placed on the upper centering tube 1*a* and slinging of the upper half of the lining is conducted. At the beginning of this part of operation both the slot 2 of the lower template 1*b* and the slot 2 of the upper template 1*a* are connected to the suction device 8 via the respective filter chamber 3, suction tubes 6 and the connected centering tubes 7*a* and 7*b*. The slinging is conducted over the suction slot 2 of the lower template 1*b* whereby an annular mass edge 18 is formed on the inner side of the lining 17 as shown in FIG. 3. The vertical slinging operation is not disturbed by sucking off the dust through the slot 2 of the lower template 1*b*, as the dust is sucked off inwards and upwards, i.e. in a different direction to the vertically slung refractory mass. After this closing the slot 2 of the lower template 1*b* the full suction capacity acts on the slot 2 of the upper template 1*a*.

The annular mass edge 18 which forms during slinging past the slot (FIG. 3) is readily sheared without difficulty on opening the template door 14 and on drawing the template 1*b*. In case of one part-template only one suction slot 2 with respective filter chamber 3, suction tube 6 and centering tube 7 is provided. To guarantee a good suction up to the end of the slinging operation in this case according to one alternative, the template 1 extends beyond the height of the ladle wall so that the lower edge 12 of the suction slot 12 is in the height of the upper end of the ladle 10. According to the more preferred alternative, the template 1 does not extend beyond the upper end of the ladle 10 but ends substantially at the same height as that of the upper end of the ladle 10 so that the lower edge 12 of the suction slot 2 is situated about 250 mm below the upper end of the ladle 10. In this case it is preferred to stop the slinging operation at the height of the lower edge 12. The removing part of the lining of about 250 mm is finished by bricks in the usual manner. Certainly one can also sling over the slot as described in connection with FIG. 3 in the case of the lower template, but it has to be recognized that in this case there is no possibility for dust removal.

The device of the present invention enables excellent dust removal with minimum suction capacity of the apparatus and minimum component parts. For instance, adequate dust removal has been achieved for a template having a diameter of 3750 mm and a thickness of walls to be slung of 180 mm when the suction slot was about 60 mm wide (the distance from the upper side to the drawn-in lower edge) and the suction aggregate sucked off amounted to about 5 $m^3$/sec. The pressure difference between the free space 11 and the inner area of the template 13 amounted in this case to about 300 $kg/m^2$, the speed of entrance of the sucked off dust being slightly above 20 m/sec.

I claim:

1. A device for removing dust particles disposed during slinging the lining of a reactor said reactor having spaced from the inner wall a generally vertical template, and a suction conduit having an inlet and outlet inside said template, said inlet being in fluid communication with particles disposed near the upper edge of said template, said suction conduit including filtrating means for filtering out entrained particles from air sucked therethrough, the filtering means including means for collecting filtered particles, the outlet end of said suction conduit including means for sucking air therethrough.

2. A device according to claim 1 wherein said inlet is disposed below the upper edge of said template and includes a portion which vertically descends behind said template.

3. A device according to claim 2 wherein said filter means comprises at least one filter tube in said vertically descending portion and said suction conduit includes a generally horizontally disposed portion facing a lateral wall of said filter tube.

4. A device according to claim 3 wherein beneath said filter tube there is a filter chamber for collecting filtered particles.

5. A device according to claim 4 wherein there are a plurality of said filter tubes in the form of filter hoses which feed into at least one dust collection funnel.

6. A device according to claim 1 wherein the inlet to said suction conduit comprises a slot having a lower edge disposed away from said inner wall and inwardly directed towards said suction conduit.

7. A device according to claim 1 wherein said template is generally conical, there are a plurality of suction conduits each of which has a separate inlet in fluid communication with particles disposed near the upper edge of said template, each of which is connected to a common centrally disposed hollow centering tube.

8. A device according to claim 7 wherein said suction conduit includes portions running radially from a vertically disposed centering tube which portions terminate in a generally vertical zone, which vertical zone contains means for filtering air passing through said inlets towards said centering tube.

9. A device according to claim 8 wherein said means for filtering air comprises a filter tube disposed in a filter chamber beneath which there is a means for collecting filtered particles.

10. A device according to claim 8 wherein said centering tube comprises a ventilator connected to a means for sucking air through said suction conduit.

11. A device according to claim 8 wherein there are a plurality of divided templates, one disposed over the other, each of which has connected thereto a plurality of suction conduits, each of which suction conduits has a separate inlet in fluid communication with a region above the upper edge of the portions of the divided templates, each of which suction conduits is connected to a common centrally disposed hollow centering tube for all portions of said divided template.

12. A device according to claim 11 wherein said common centrally disposed hollow centering tube comprises an upper portion and a lower portion, one of which is guidingly connected to the other so as to be in fluid communication therewith.

13. A device according to claim 12 wherein the upper portion and lower portion of said centering tube are connected together by a tube guide and said lower portion includes means for sucking air through said upper and lower portions.

14. A process for removing dust during the lining of a reactor wherein a slinging mass is slung onto the inner walls of said reactor disposed a distance from an opposing template whereby a free space is defined between the reactor wall and the template which process comprises sucking dust in said free space from a point above the upper edge of said template into a region behind said template.

15. A process according to claim 14 wherein said template is cylindrical and said dust is sucked inwardly away from the walls of said template.

16. A process according to claim 15 wherein said dust is sucked generally vertically away from the upper marginal edge of said template.

17. A process according to claim 16 wherein said dust is passed through said filter means and descends vertically by gravity and entering air is withdrawn radially away from said template.

18. A process according to claim 17 wherein dust withdrawn from the region above the upper edge of said template is deflected downwardly in the inner area of said template.

19. A process according to claim 14 wherein the pressure difference between said free space and a point downstream thereof on which suction is imposed is 200 $kg/m_2$.

* * * * *